US005546075A

United States Patent [19]

Shimoji

[11] Patent Number: 5,546,075

[45] Date of Patent: Aug. 13, 1996

[54] WARNING APPARATUS

[75] Inventor: Tamotsu Shimoji, Kyoto-gun, Japan

[73] Assignee: Daifuku Co., Ltd., Osaka, Japan

[21] Appl. No.: 501,154

[22] Filed: Jul. 11, 1995

Related U.S. Application Data

[63] Continuation of Ser. No. 249,946, May 27, 1994, abandoned.

[51] Int. Cl.[6] ..... G08B 21/00

[52] U.S. Cl. ..... 340/666; 116/98; 116/139; 340/404.1

[58] Field of Search ..... 340/666, 541, 340/544, 691, 404.1; 116/98, 137 R, 139; 446/397, 486; 472/134; 200/85 R; 52/177, 582.1

[56] References Cited

FOREIGN PATENT DOCUMENTS 93800 3/1992 Japan .

308998 10/1992 Japan ..... 116/98

242373 9/1993 Japan ..... 116/98

*Primary Examiner*—Thomas Mullen

*Attorney, Agent, or Firm*—Koda and Androlia

[57] ABSTRACT

A warning apparatus comprising a plurality of warning mat units interconnected and arranged side by side in a such manner as to surround a dangerous area, in which the warning mat units each comprise a base plate, a flexible cover sheet secured to an upper side of the base plate, the cover sheet being provided with a plurality of upwardly expanded shells having an inside hollow room and air circulation apertures, and a warning sound generator accommodated in the inside room of the shell, in which the warning sound generator comprises a closed elastic tube fastened on the base plate and a whistle affixed to a wall aperture of the closed elastic tube so as to give forth sound by the effect of air flow passing between an inside and an outside of the closed elastic tube.

3 Claims, 3 Drawing Sheets

WARNING APPARATUS

This is a continuation of application Ser. No. 08/249,946, filed May 27, 1994, abandoned.

FIELD OF THE INVENTION

The present invention relates to a warning apparatus for preventing persons from entering a dangerous area in a factory, a building site or the like, and more particularly to a warning apparatus for warning persons stepping near to a dangerous area by giving forth a warning sound.

BACKGROUND OF THE INVENTION

Such a dangerous area is found, for example, in an automobile assembly factory in which a flat structure of panels or safety wire nets is held horizontally on a level between a ground and a horizontal arrangement of elevated rails for conveying car bodies or the like suspended therefrom, with the purpose of preventing the suspended objects from falling down to the ground, and for providing a standing support for workers engaged in checking and maintenance of the rails. More particularly, in the flat structure of panels or safety wire nets, there is formed an opening for lowering the suspended objects halfway with an upright lifter. The lifter and a special vertical rail section from the horizontal rails are arranged so as to pass through the opening which is formed in the panels or the safety wire nets. However, this opening is very dangerous to the workers because there is a likelihood that a worker may step into and fall into the opening carelessly and hurt oneself seriously.

Thus, a preventive countermeasure has been hitherto taken against the dangerous area. That is, a floor mat with a build-in pressure sensitive sensor is placed down adjacent dangerous areas such as the above-mentioned opening so that, when the worker steps on the mat, the sensor generates a detection signal to activate a buzzer which is placed in a proper position remote from the mat. In this manner, the sound of the buzzer causes the stepping worker to notice the immediate dangerous area. However, the known floor mat with the built-in sensor needs other electrical equipment such as an electric power source, electric wires and a control unit, so that a problem lies in the complexity of installation and the increased costs of production and maintenance.

SUMMARY OF THE INVENTION

It is accordingly one object of the present invention to provide a warning apparatus which can operate by itself mechanically in response to an external force, not by electric energy, so as to never require electrical equipment, such as a power source, It is a further object of the invention to provide a warning apparatus which can be installed easily in a desired position and shape and is relatively low in costs of production and maintenance.

It is a further object of the invention to provide a warning apparatus having a warning sound generator of superior durability.

With the above objects in view the present invention provide a warning apparatus comprising a plurality of warning mat units interconnected and arranged side by side in a such manner as to surround a dangerous area, wherein the warning mat units each comprise a base plate, a flexible cover sheet secured to an upper side of the base plate, the cover sheet being provided with a plurality of upwardly expanded shells having an inside hollow room and air circulation apertures, and a warning sound generator accommodated in the inside room of the shell, wherein the warning sound generator comprises a closed elastic tube fastened on the base plate and a whistle affixed to a wall aperture of the closed elastic tube so as to give forth sound by the effect of air flow passing between an inside and an outside of the closed elastic tube.

Preferably, the closed elastic tube of the sound generator is set upright on the base plate and is pleated so as to be contractible and expansible in a perpendicular direction, while the whistle is affixed to the aperture formed on a side wall of the closed tube. A protective frame is set around a bottom of the closed tube so as to protect the sound generator from damage. Each of the warning mat units is connected with that adjacent thereto into one body by detachable tie means.

BRIEF DESCRIPTION OF THE DRAWINGS

The present invention will now be described by way of example with reference to the accompanying drawing in which.

DETAILED DESCRIPTION OF THE PREFERRED EMBODIMENT

Figure 1:
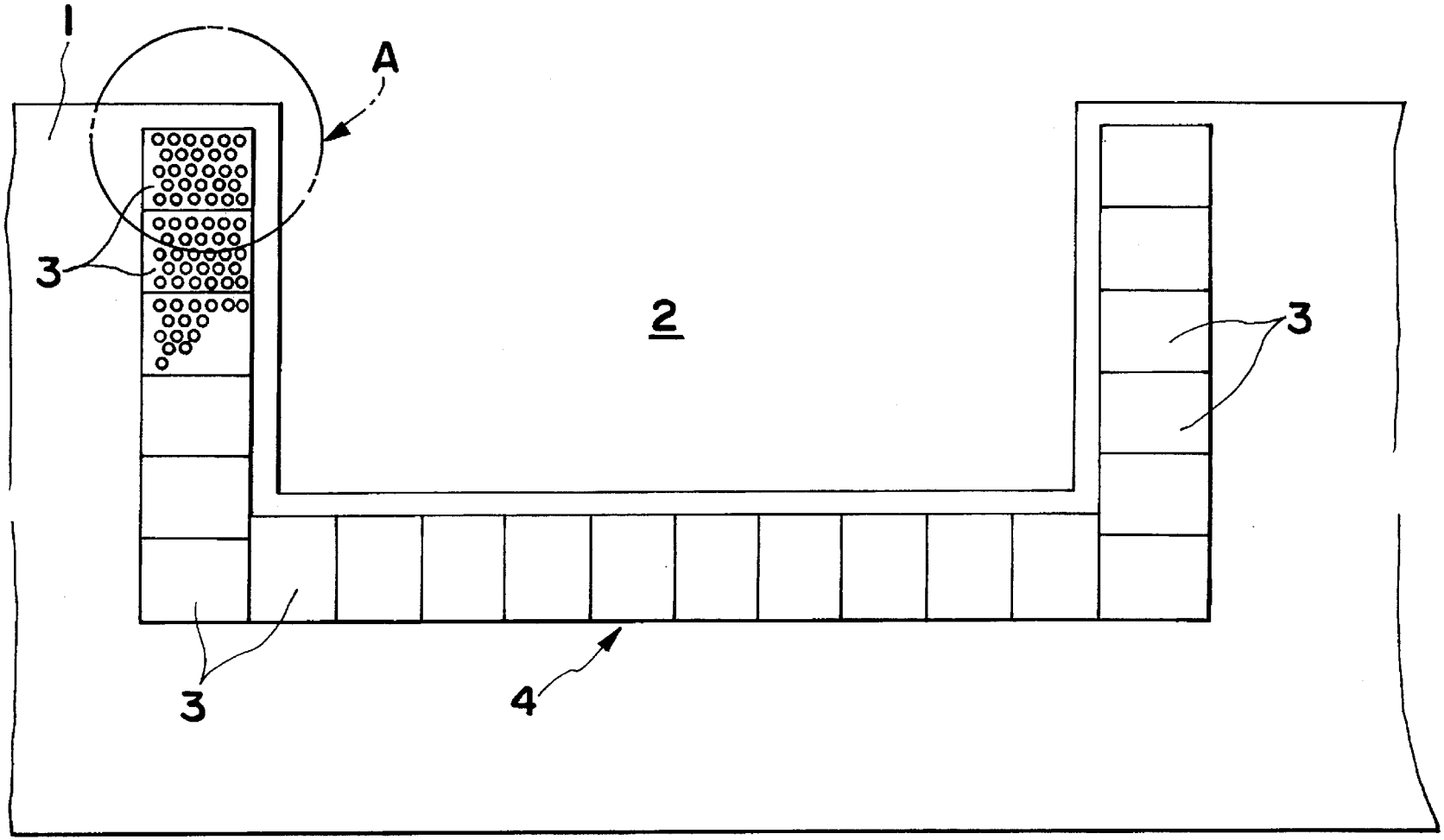
FIG. 1 is a plan view of a warning apparatus embodying the present invention.

Referring to FIG. 1, the reference numeral 1 designates an aboveground passage way provided for worker's checking and maintenance, made up of panels or safety wire nets, which is set horizontally in a level between a ground and a horizontal arrangement of elevated rails for conveying car bodies on the like suspended therefrom, for example, in an automobile assembly factory. The numeral 2 designates an opening for vertical movement of a lifter (not shown). The opening is formed in the passage way 2 and is a dangerous area to the passing workers. A warning apparatus, shown generally by the numeral 4, comprises a plurality of warning mat units 3 placed down on the passage way 2 so as to surround the opening 2 thereof with the adjacent warning mat units interconnected to one another. Besides, safety fences (not shown) are provided on the longitudinal and lateral edges of the passage way 1/

Figure 2:
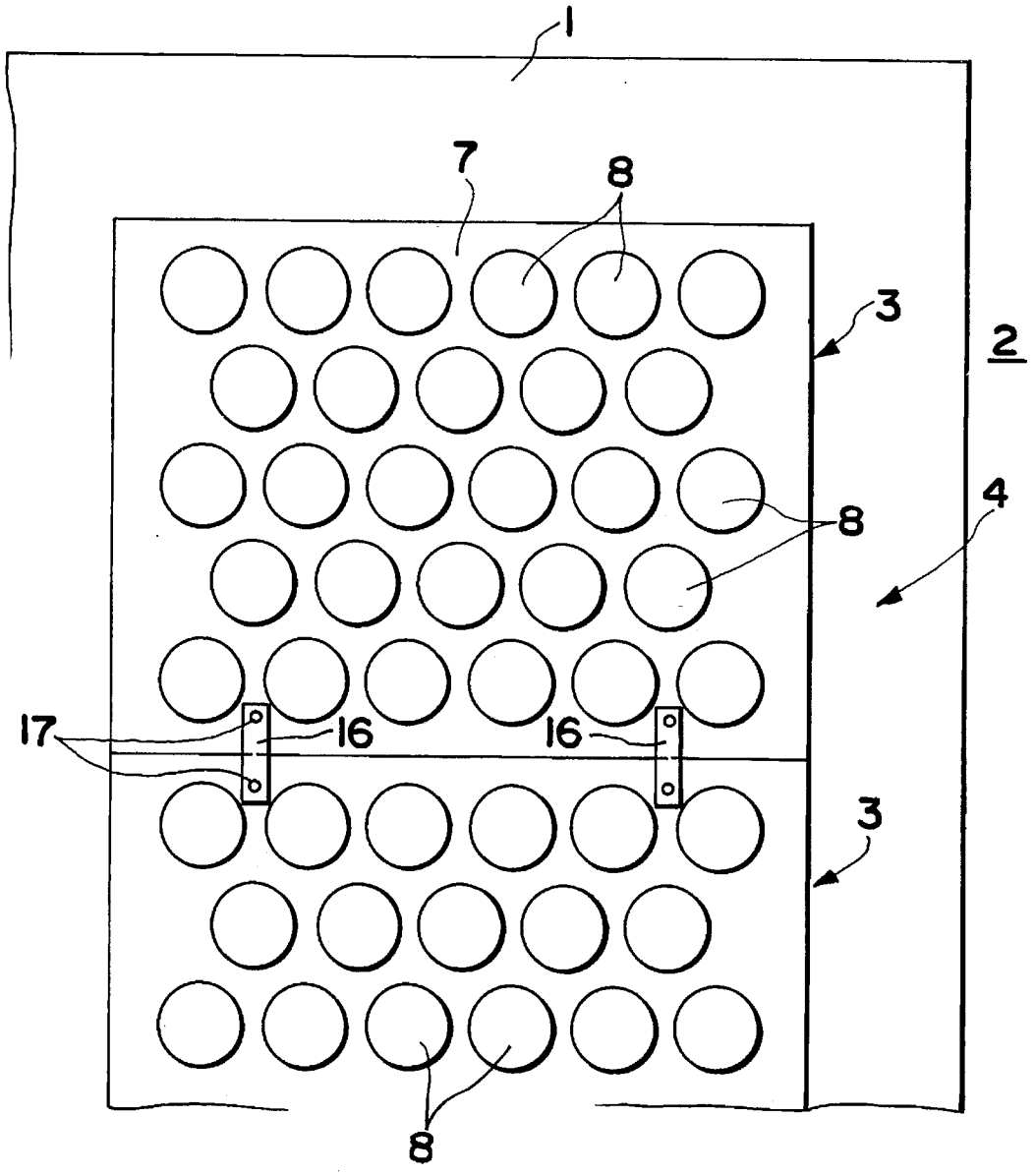
FIG. 2 is an enlarged plan view of a part of the same apparatus within a dot-line circle as shown by an arrow A in FIG. 1.
Figure 3:
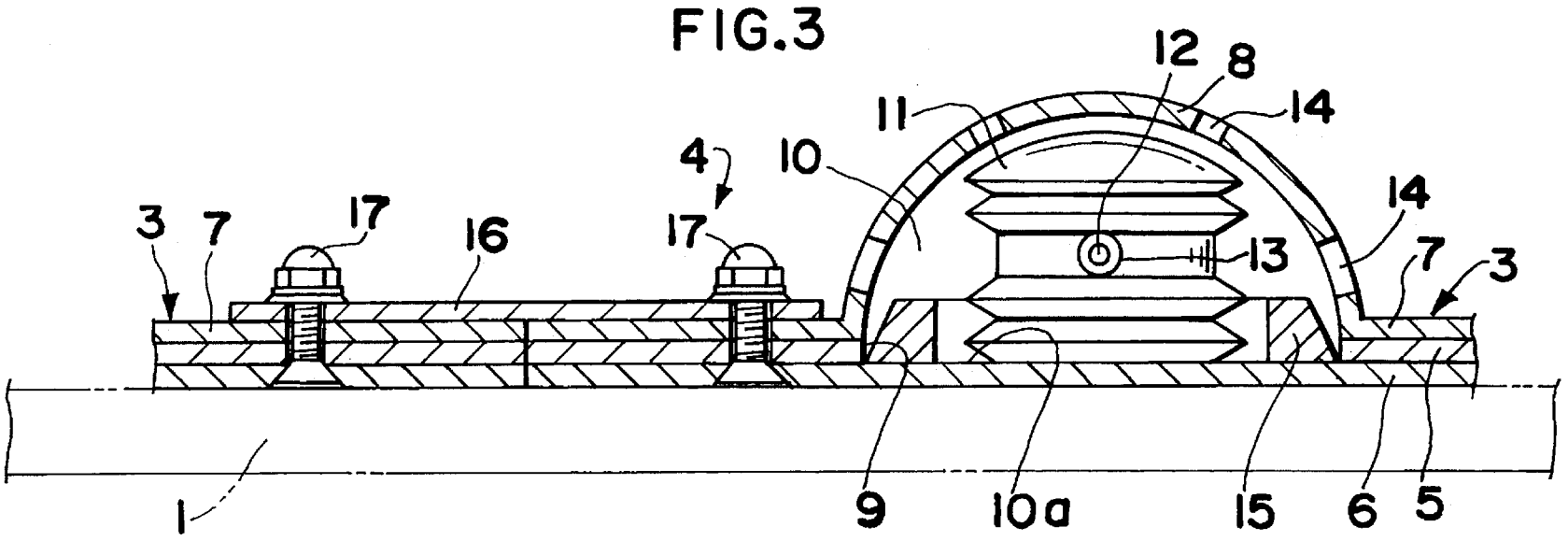
FIG. 3 is an enlarged cross-sectioanl view of the main part of the warning apparatus.

The above-mentioned warning mat units 3 each comprise, as shown in FIGS. 2 and 3, a pair of upper and lower base plates 5, 6 of plywood coupled to one another with an adhesive, and a cover sheet 7 of flexible rubber or plastics which is secured to the upper side base plate 5 with a adhesive and has a large number of elastic hemispherical shells 8 expanded upwardly with an inside hollow room 10. The upper side base plate 5 is provided with circular holes 9 made by cutting off the portions opposed to the inside of the shells 8, so that the hemispherical hollow room 10 within the shell 8 is bounded by an unconcealed surface 10*a* of the lower side base plate 6 adjacent to the hole 9 of the upper side base plate 5. In the hollow room 10, there is accommodated and set upright a closed elastic tube 11 which is pleated like a camera bellows so as to be contractible and expansible in a longitudinal direction. The pleated elastic tube 11 has a convex head and an air flow aperture 12, formed on the middle of the circular side wall, to which a whistle 13 is secured. The pleated elastic tube 11 has a flat bottom fixed on the unconcealed surface 10*a* of the lower side base plate 6 with a pressure sensitive adhesive double coated tape or an adhesive.

Further, in each of the hemispherical shells 8 of the cover sheet 7, there is provided a plurality of air circulation apertures 14. In the inside of the shells 8, a circular protective frame 15 of hard rubber is set around the bottom of the pleated elastic tube 11 and adhered to the unconcealed surface 10*a* of the lower side base plate 6, so that the pleated elastic tube 11 and the whistle 13 can be protected from damage due to an external force when the shells 8 of the cover sheet 7 are depressed by the foot of the stepping worker.

The required number of the warning mat units 3 so constructed are arranged outside and along the periphery of the opening 2 of the passage way 2, as shown in FIG. 1, in a substantially U-like form in a plan view, while each of the warning mat units 3 is connected with the adjacent one in tight contact, as shown in FIG. 3, by tie means such as bolts 17 and elongated tie pieces 16 extending over two adjacent mat units, whereby the warning apparatus 4 is formed in one body. The warning mat units 3 each are fastened on the passage way 1 with pressure sensitive adhesive double coated tapes.

The warning apparatus, which is installed on the passage way 2 so as to surround the dangerous area, operates as follows. When the worker moving on the passage way 3 steps on any of the warning mat units 3, the stepping pressure causes the shells 8 of the cover sheet 7 and the plated elastic tube 11 to be deformed and contracted, while the air within the pleated tube 11 is pumped out through the whistle 13 secured to the air flow aperture 12, so that the whistle 13 gives forth sound for warning the worker that there is a dangerous area in front of him.

In the above-described embodiment of the warning apparatus, the whistle 13 is arranged to give forth sound when the passing worker steps on the warning mat 3. However, the whistle 13 can be otherwise arranged to give forth sound when the worker lifts his foot from the warning mat 3. In the latter case, the pleated elastic tube 11 returns from the contracted state to an original upright state, while the outside air is pumped into the pleated tube 11 through the whistle 13, so that the whistle 3 gives forth a warning sound.

According to the embodiment, the upwardly expanded shells 8 in each cover sheet of the warning mat units 3 are formed into a hemisphere in appearance. However, the shape of the shell is not limited to this particular shape, and may be formed, for example, into a cuboid in appearance. Further, with a flat cover sheet of no shell, a single hollow room of larger volume can be formed between the flat sheet and the upper side base plate of one mat unit so that a plurality of pleated elastic tubes can be accommodated in the single room. Besides, additional whistles can be secured to the air circulation apertures 14 provided on the shells of the cover sheet as well as the pleated tube.

According to the embodiment, the warning apparatus is formed into a substantially U-like shape in a plan view while the adjacent mat units are connected with one another in tight contact. However, different shapes, such as a loop, a rectangle or a L-character in a plan view, can be adopted in arrangement of the mat units, depending upon the peripheries of the dangerous area. It is allowed that the adjacent mat units are connected with one another by tie means.

As described above, the warning apparatus of the invention is so constructed as to operate by oneself mechanically in response to an external force without using a power source and other electrical equipment such as a control unit and electrical wires as in the prior art. Thus, according to the warning apparatus of the invention, its installation is feasible in a desired position, and its costs can be reduced in both aspects of production and maintenance. In addition, the warning apparatus of the invention is comprised of a plurality of warning mat units, so that its shape in appearance is changeable depending upon the peripheries of dangerous areas.

Further, the circular protective frame is set within the shell of the cover so as to surround the bottom of the pleated tube and is adhered to the base plate, so that the pleated tube with the whistle can be saved from damage when depressed severely by the foot of the worker, thus being superior in durability. Incidentally, a common article on the market can be used as the whistle so as to reduce the cost of production.

While one embodiment of the invention is described and illustrated herein, it is intended to be representative only, as changes can be made without departing from the present invention as defined by the claims.

What is claimed is:

1. A warning apparatus comprising a plurality of warning mat units interconnected and arranged side by side in such a manner as to surround a dangerous area, wherein the warning mat units each comprise a base plate, a flexible cover sheet secured to an upper side of the base plate, the cover sheet being provided with a plurality of upwardly expanded shells having an inside hollow room and air circulation apertures, and a warning sound generator accommodated in the inside room of the shell, wherein the warning sound generator comprises a closed elastic tube fastened to the base plate and a whistle affixed to a wall aperture of the closed elastic tube so as to give forth sound by the effect of air flow passing between an inside and an outside of the closed elastic tube, and wherein a plurality of the warning mat units are connected adjacent one another by detachable tie means so as to be formed into one integrated body and a protective frame is set around a bottom of the closed elastic tube and said protective frame has a top portion extending higher than those parts of the cover sheet which are secured to the base plate, whereby excessive depression of the closed tube when the warning mat units are stepped on is prevented.

2. A warning apparatus as defined in claim 1, wherein the closed elastic tube of the sound generator is set upright on the base plate and is pleated so as to be contractible and expansible in a perpendicular direction, while the whistle is affixed to the wall aperture formed on a side wall of the closed tube.

3. A warning apparatus according to claim 2, wherein said detachable tie means comprises elongated tie pieces extending over two adjacent warning mat units and bolts extending through said elongated tie pieces and said warning mat units.

* * * * *